US009339689B2

(12) United States Patent
Faloyo

(10) Patent No.: US 9,339,689 B2
(45) Date of Patent: May 17, 2016

(54) FOOT EXERCISE DEVICE

(71) Applicant: Christopher Olaniran Faloyo, Hamburg (DE)

(72) Inventor: Christopher Olaniran Faloyo, Hamburg (DE)

( * ) Notice: Subject to any disclaimer, the term of this patent is extended or adjusted under 35 U.S.C. 154(b) by 240 days.

(21) Appl. No.: 14/081,205

(22) Filed: Nov. 15, 2013

(65) Prior Publication Data

US 2015/0141211 A1 May 21, 2015

(51) Int. Cl.

| | |
|---|---|
| ***A63B 21/00*** | (2006.01) |
| ***A63B 23/10*** | (2006.01) |
| ***A63B 26/00*** | (2006.01) |

(52) U.S. Cl.
CPC ..... *A63B 23/10* (2013.01); *A63B 21/4015* (2015.10); *A63B 26/003* (2013.01); *A63B 2209/14* (2013.01)

(58) Field of Classification Search
CPC ..... A63B 21/00
USPC ..... 482/74, 75, 76
See application file for complete search history.

(56) References Cited

U.S. PATENT DOCUMENTS 2,756,517 A * 7/1956 Youtz ..... 36/7.8

FOREIGN PATENT DOCUMENTS

| | | | |
|---|---|---|---|
| DE | 87 10 357 | U1 | 9/1987 |
| DE | 93 03 545 | U1 | 5/1993 |
| DE | 200 05 505 | U1 | 9/2000 |
| DE | 201 12 569 | U1 | 2/2002 |
| DE | 203 10 517 | U1 | 9/2003 |
| DE | 20 2010 003 161 | U1 | 6/2010 |
| DE | 10 2009 028 471 | A1 | 2/2011 |

* cited by examiner

*Primary Examiner* — Jerome W Donnelly
(74) *Attorney, Agent, or Firm* — Collard & Roe, P.C.

(57) ABSTRACT

A foot exercise device includes at least one attachment means for a foot and a sole that forms a closed accommodation space having one or more compressible chambers to accommodate a particulate material or a fluid. The surface of the sole reaches beyond the foot surface circumferentially around the sides.

8 Claims, 4 Drawing Sheets

FOOT EXERCISE DEVICE

1. TECHNICAL FIELD

The present invention relates to an exercise device for strengthening the foot, ankle, and leg musculature.

2. STATE OF THE ART

In the state of the art, exercise devices for strengthening the foot, ankle, and leg musculature are known. A mobile foot exercise device having two foot plates is known from DE 9303545 U1; these plates are mounted on a carriage, in each instance, which slides in a rail on the bottom of the device, in each instance. To achieve the exercise effect, the foot plates are moved by means of the feet positioned on them, in back and forth sliding movements, whereby the device counters the movement with a displacement resistance that can be set at different levels. DE 20005505 U1 discloses a foot exercise device on which the feet are set down with the front foot area, while the heels remain on the floor. An exercise effect is achieved as a result of the tension of the calf muscles that exists in this connection, and by the fact that the body is pressed up from the heel position into the toe position. From DE 20310517 U1, a leg and foot exercise device is known, which has a housing having motor-driven, vibrating pedals intended for the feet to be placed on them. DE 8710357 U1 discloses a foot exercise device consisting of a rigid base part, the flat top of which is configured with a step-elastic stepping surface cushioning, which forms a relief on which walking is possible. During exercise, the feet are set down onto the stepping surface cushioning, in alternate steps or also at the same time, heels first, barefoot or only wearing socks, and rolled over by way of the balls of the toes. The aforementioned exercise devices have in common that the use of a separate device, separate from the feet, is required for exercise, in each instance. This restricts the exercise possibilities, because only the stepping surface made available by the device can be utilized, in each instance, and free movement of the body through space is not possible during exercise. The aforementioned exercise devices therefore cannot be used while simultaneously performing movement types of sports or exercises.

From DE 10 2009 028 471 A1, a foot cuff is known that encloses the ankle and the center part of the foot and has a chamber that can be filled with a fluid (water or gas) in the ankle region, in order to exert a flotation effect during exercise in the water or an additional weight on the wearer during exercise outside of the water. The exercise in water made possible in this manner does not have any effect on the foot and ankle musculature. In outdoor exercise, as well, only a very indirect effect on the foot and ankle musculature is exerted by means of the additional weight created with the water filling. Finally, movement exercise with additional weights at the ends of the extremities is often not desirable, because the additional weight puts additional stress and strain on the joints.

DE 201 12 569 U1 discloses a shoe having a sole and an upper shoe part, whereby the sole is configured with at least one chamber for accommodating a particulate material (sand, plastic granulate, etc.) as a damping element, in order to absorb the impact when stepping down and to prevent a recoil on the body of the wearer, particularly the knee joints and the spinal column. The damping element dissipates the impact energy, in that the particulate material is displaced and compressed. The shoe disclosed by DE 201 12 569 U1 particularly serves for use as a conventional sports shoe. Performance of conventional sports activities that is gentle on the joints is made possible. Aside from the better damping of the sole, no new effect and possibility of use as compared with conventional sports shoes is opened up by DE 201 12 569 U1, and in this regard, no deviating shoe structure is disclosed, either. The shoe is therefore not suitable for use as an exercise device for targeted strengthening of the foot, ankle, and leg musculature.

From DE 20 2010 003 161 U1, a shoe having a sole having at least one chamber that is filled with small elements (e.g. polyester beads), the diameter of which amounts to between 1 and 3 mm, is known. The shoe disclosed by DE 20 2010 003 161 U1 serves to imitate running on a sandy subsurface. By means of the corresponding displacement of the elements, the sole has a particularly supporting effect in the region of the foot arch and exerts a positive effect on the foot shape. The shoe disclosed by DE 20 2010 003 161 U1 serves for conventional use as a shoe, whereby a positive health effect is achieved. Aside from the health effect, no new effect is opened up by DE 20 2010 003 161 U1, as compared with conventional shoes, and in this regard, no new shoe structure is disclosed, either. The shoe is therefore not suitable for use as an exercise device for targeted strengthening of the foot, ankle, and leg musculature.

3. PRESENTATION OF THE INVENTION

The invention is based on the task of creating an exercise device for strengthening the foot, ankle, and leg musculature and of avoiding the disadvantages of the state of the art as described. It is supposed to be possible to use the exercise device when performing movement types of sports or exercises, and is supposed to allow free movement of the body through space.

This task is accomplished, according to the invention, by means of a foot exercise device according to claim 1; advantageous embodiments are described in the dependent claims.

The core of the invention is formed by a foot exercise device having at least one attachment means for a foot and having a sole that forms a closed accommodation space having one or more compressible chambers, to accommodate a particulate material or a fluid, whereby the surface of the sole reaches beyond the foot surface circumferentially around the sides. The shape and the filling (particulate filling or fluid) of the sole and the elasticity of the material that forms the sheath of the sole is selected in such a manner that compression and deformation of the sole sufficient for achieving the exercise effect exist when stepping down, with simultaneously still sufficient stability of the exercise device for use as footwear while performing movement types of sports (for example running types of sports, boxing training and sparring, ball types of sports) or exercises (for example gymnastics, equipment training or exercises with weights). The foot "floats" within the exercise device when stepping down, in that the sole is compressed and deforms as a function of the movement direction of the wearer, with the vector of the forces in effect when stepping down (compression and displacement or relocation of the particulate material or fluid within the sole), so that the foot is displaced with the compression and deformation of the sole relative to the subsurface and toward the underside of the sole that rests on the floor/ground, and also a rotation can tend to occur. In this connection, it is important that the surface of the sole projects to the sides circumferentially beyond the foot surface, because only this creates the degree of freedom required for movement of the foot parallel to the subsurface, without the wearer turning his/her ankle. If the surface of the sole were to end with the foot surface on the side circumference, as in the case of a conventional shoe, the foot would slip beyond the edge of the sole when stepping down, with the compression and distortion of the sole, and would turn, and the wearer would turn his/her ankle. Because the surface of the sole reaches beyond the foot surface in the case of the exercise device according to the invention, the foot can shift a little bit further in the movement plane, parallel to the subsurface, when stepping down, with the deformation of the sole; it "floats" with the compression of the sole when stepping down, without turning of the ankle. In this way, increasing demands are placed on the foot, ankle, and leg musculature, because the wearer must maintain equilibrium when stepping down, and might also have to work to counter a turning impulse. An effect comparable to that of a running movement on sand or mud, with the accompanying sinking and slipping of the foot that is connected with this when stepping down, occurs. The wearer balances out floating of the foot when stepping down by displacing the body's center of gravity by means of corresponding balancing movements, holds the foot in a parallel position relative to the subsurface (in other words counteracts the turning impulse), and thereby maintains equilibrium. In this connection, the entire muscle apparatus from the torso musculature to the foot musculature is involved. The foot and leg musculature, in particular, must perform significantly more work than in a conventional shoe. The invention has recognized that an exercise device for strengthening the foot, ankle, and leg musculature can be configured as a sole attached to the foot, instead of as a device separate from the feet. This offers the advantage that strengthening of the foot, ankle, and leg musculature by way of performing movement types of sports or exercises is made possible. The invention has furthermore recognized that this is achieved in that the conventional properties of a shoe are modified, if possible in that the exercise device is worn fixed in place on the foot, as footwear, and offers the sole of the foot protection from the subsurface, similar to a shoe, but at the same time does not offer the foot a stable seat when stepping down, but rather—contrary to a shoe—an unstable seat.

In a particular embodiment, the exercise effect is reinforced in that the material that forms the sheath of the sole has a greater resilience in the region of the top that carries the foot (in other words only in the region of the foot contact surface) than in the remaining region of the sole. This is achieved in that the material forming the sheath of the sole is provided with a lesser material thickness or a more resilient material structure (for example as a perforation, machining of grooves, or structuring it as a woven fabric), or that a more resilient material is selected in this region. In this way, the foot surface sinks into the sole to a greater degree when stepping down, and the effects described, particularly the turning impulse, are reinforced, whereby at the same time, sufficient deformation stability of the sole is still guaranteed, as a whole, by means of the less resilient structure in the region of the flank and the underside, so that movement types of sports or exercises can be performed.

The formation of an ergonomic foot bed is achieved in that the closed accommodation space of the sole is structured with multiple compressible chambers that are configured to be closed in themselves, in each instance. For this purpose, the filling of the chamber is structured in such a manner, in each instance, that it demonstrates lesser compressibility in regions that are supposed to act to support the foot surface in the corresponding part than in the other regions. This is achieved either by means of tighter filling of these chambers or by means of the use of a particulate material or fluid having lesser compressibility in these chambers.

The sole adapts to the foot shape of the wearer when used in that the closed accommodation space of the sole is structured with multiple compressible chambers that are connected with one another, so that an exchange of the particulate material or fluid takes place between them upon compression. In this embodiment, an exchange of the fill material or fluid among the chambers takes place as a function of the shape of the profile of the foot surface of the wearer.

To increase the wear resistance of the sole of the exercise device, an additional outer sole is provided on the underside of the sole. This furthermore allows profiling of the ground floor/contact surface with regard to individual types of sports or subsurfaces, independent of the functional configuration of the sole.

An increase in the stability of the sole of the exercise device is achieved by means of integrating additional reinforcement elements that either run within the sole or engage around it. The shape, stiffening strength, and type of reinforcement elements are selected on the basis of the reinforcement effect being aimed at. This particularly allows adapting the exercise device to special stress requirements of specific concrete movement types of sports or exercises. In this way, the exercise device can be adapted to a particular degree, for example to the stresses connected with jumping, abrupt stopping, longitudinal or transverse accelerations.

Stable attachment of the foot to the exercise device is achieved in that a shaft configured to be partly open or closed is provided as an attachment means for the foot. The shaft encloses the foot and holds it firmly on the sole. A shaft configured to be completely closed allows a particularly stable seat of the foot in the exercise device. A shaft that is partly open reduces the weight of the exercise device and allows better dissipation of moisture and heat.

A particularly low weight and particularly good ventilation of the exercise device are achieved in that at least one shaft strap or a braided shaft strap is provided as an attachment means for the foot.

An alternative attachment with a reduced weight with simultaneously good ventilation and stable attachment of the foot is achieved in that one or more cuffs is or are provided as attachment means for the foot, which cuffs engage around the back of the foot and/or the heel and/or the ankle.

The exercise device according to the invention will be described in greater detail below, making reference to the attached drawings, using two exemplary embodiments:

FIG. 1 shows an exemplary foot exercise device 1 (for a left foot) in a side view. FIG. 2 shows the intermediate sole 2 of the exercise device 1 according to FIG. 1 as a schematic partial representation (without shaft 4) in a top view. The foot exercise device 1 comprises an intermediate sole 2, an outer sole 3, and a shaft 4. To attach it, the foot is inserted into the shaft 4 through the opening 4*a* of the latter, and fixed in place by means of the hook and loop closure 5. The intermediate sole 2 possesses a foot-carrying region 2*a* on its top (foot contact region). The surface of the intermediate sole 2 reaches to the sides, circumferentially, beyond this region 2*a*, around the circumference of the region 2*b*. The material that forms the sheath of the intermediate sole 2 is configured with a lesser material thickness in the region 2*a* (region of the foot contact surface) than in the total remaining region, and therefore possesses a greater resilience there. The intermediate sole 2 is additionally stabilized by the reinforcement elements 7 and 7' that are structured as reinforcing plastic clamps that partly engage around the intermediate sole 2. FIG. 3 shows the representation according to FIG. 2 as a partial representation, partly in cross-section (without reinforcement elements 7 and 7'). The intermediate sole 2 forms a closed accommodation space having a compressible chamber that is filled with the particulate material 8 (shown schematically in the form of individual particles). The particulate material 8 completely fills the accommodation space formed by the intermediate sole 2.

FIG. 4 shows an alternative embodiment of an intermediate sole 2' having multiple compressible chambers 9 to 9''', as a sectional representation in a top view. The chambers 9 to 9'''' are formed by chamber walls 10 to 10'''', in each instance, each closed in themselves, so that in the event of compression between the chambers, no exchange of the fill material (particulate material) 8' takes place. The position of the region 2*a*' that carries the foot (region of the foot contact surface) of the intermediate sole 2' is schematically shown with a broken outline line.

4. BRIEF DESCRIPTION OF THE DRAWINGS

5. COMMERCIAL USABILITY

Figure 1:
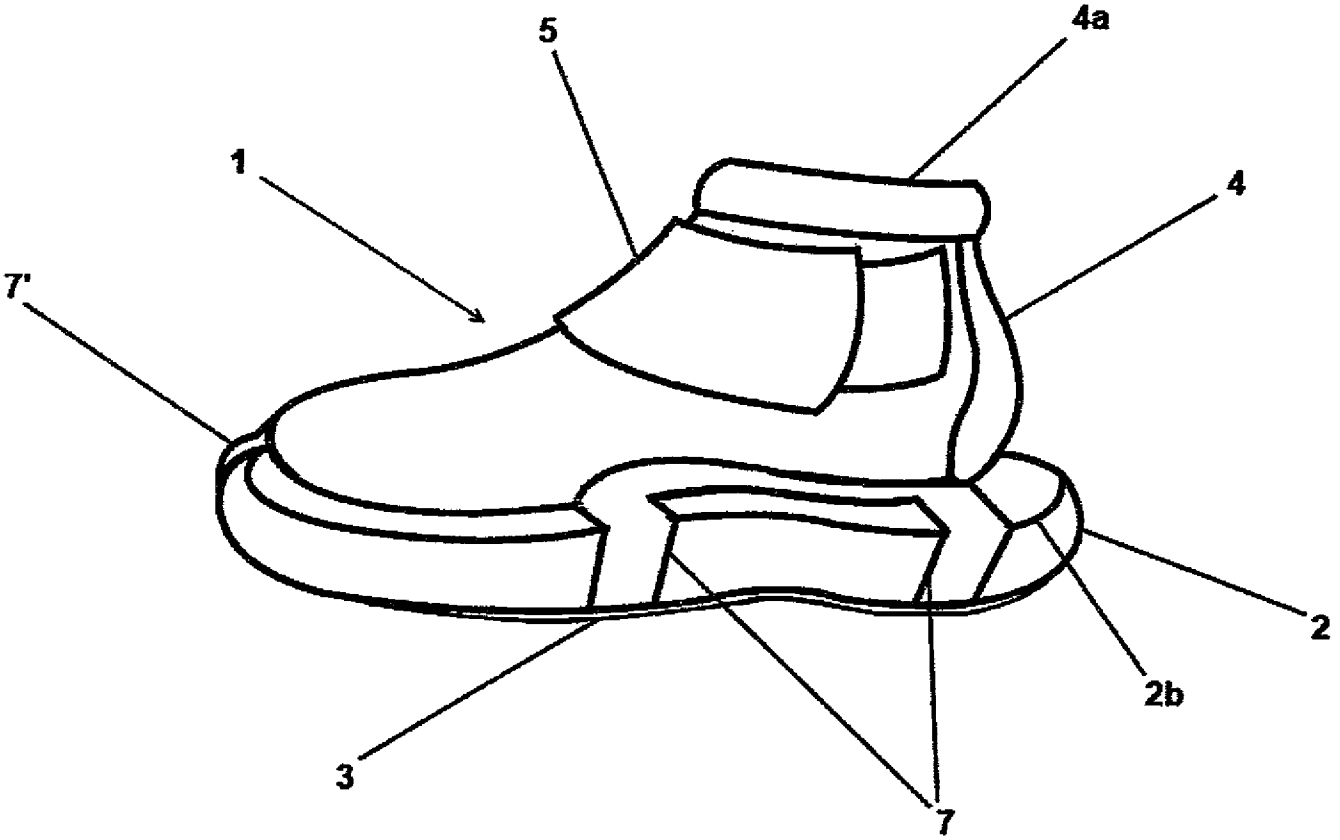
FIG. 1 is a side view of an exemplary foot exercise device.
Figure 2:
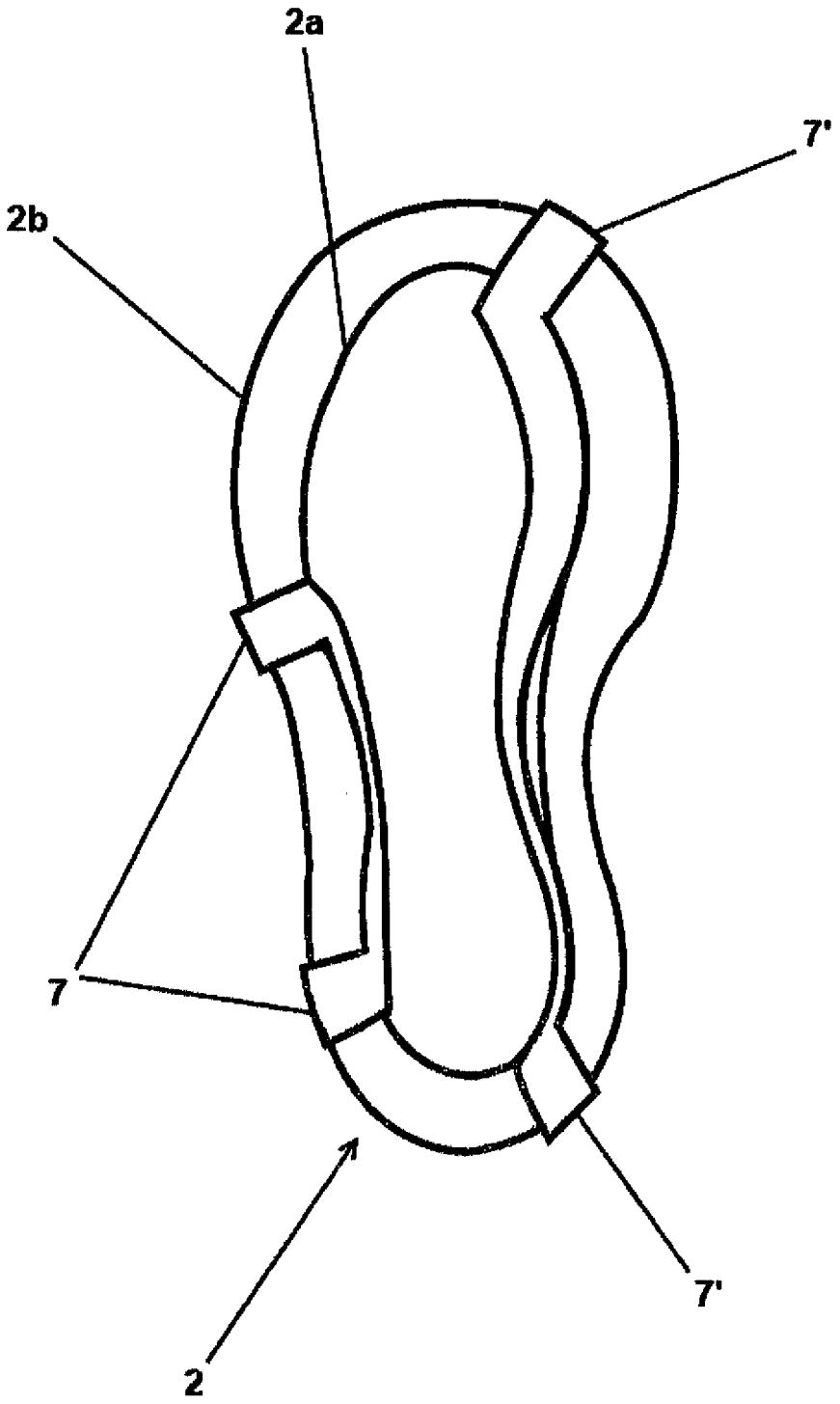
FIG. 2 is a partial sectional representation of FIG. 1.
Figure 3:
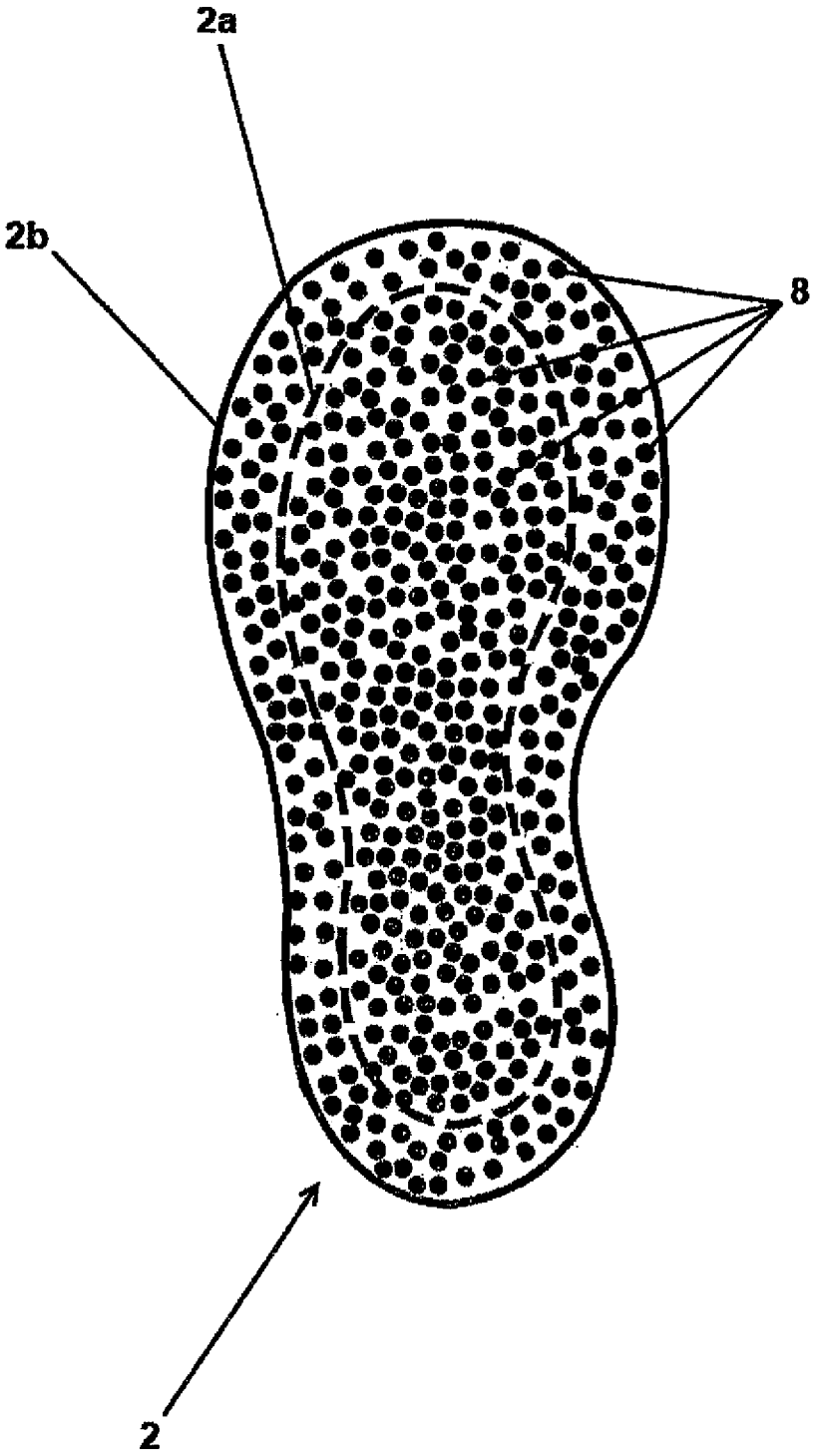
FIG. 3 is a partial sectional representation of the foot exercise device according to FIG. 1 in a top view.
Figure 4:
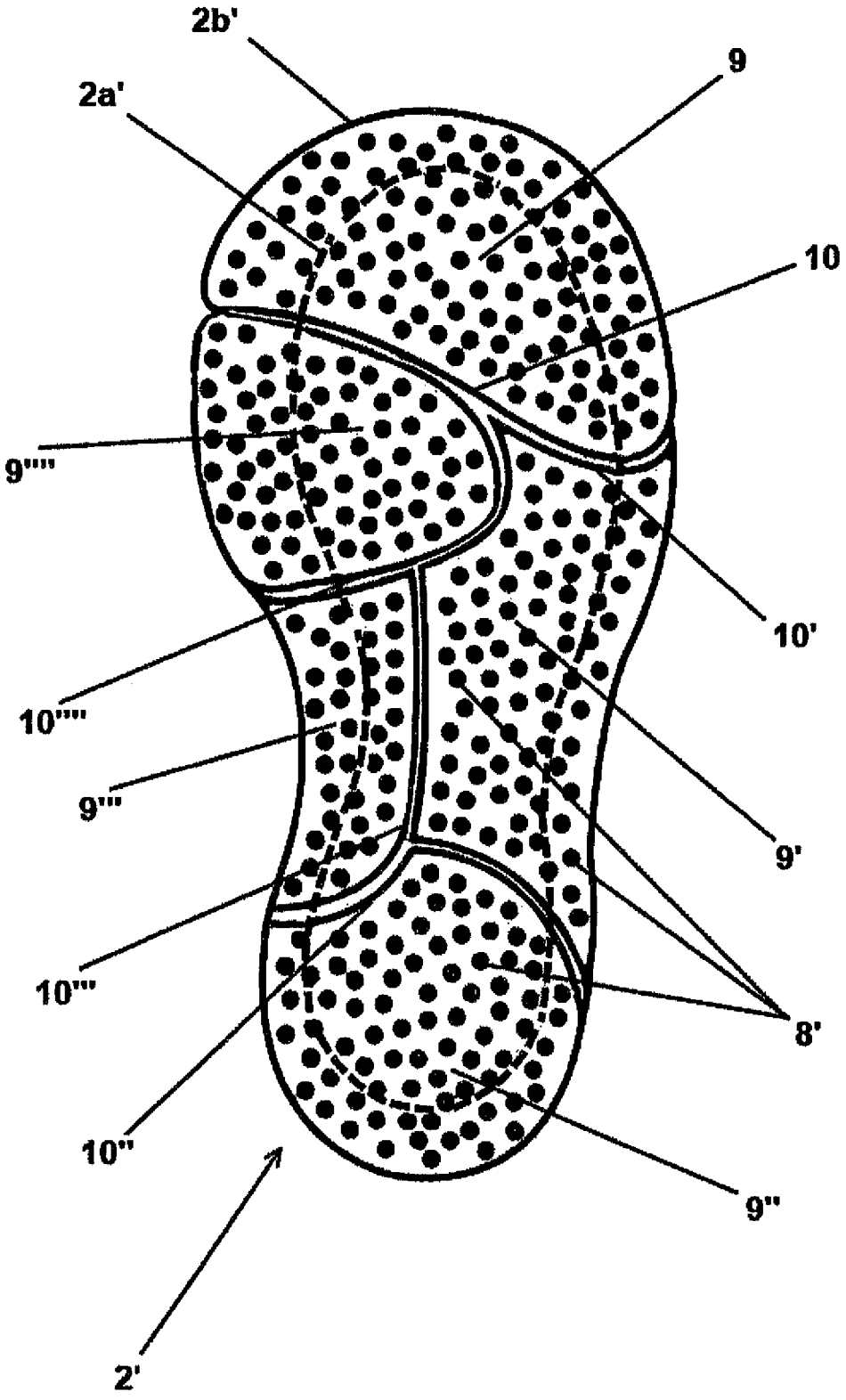
FIG. 4 is a sectional representation of a sole of an exemplary foot exercise device in a top view.

The exercise device according to the invention is suitable for performing movement types of sports and exercises for particular strengthening of the foot, ankle, and leg musculature.

The invention claimed is:

1. Foot exercise device having at least one attachment means for a foot and having a sole that forms a closed accommodation space having one or more compressible chambers, to accommodate a particulate material or a fluid, wherein the surface of the sole reaches beyond the foot surface circumferentially around the sides and wherein the material that forms the sheath of the sole has a greater resilience in the region of the top that carries the foot than in the remaining region.

2. Foot exercise device according to claim 1, having a sole that forms a closed accommodation space having one or more compressible chambers, to accommodate a particulate material or a fluid, wherein the chambers are configured to be closed.

3. Foot exercise device according to claim 1, having a sole that forms a closed accommodation space having one or more compressible chambers, to accommodate a particulate material or a fluid, wherein the chambers are connected with one another in such a manner that an exchange of the particulate material or fluid takes place between them upon compression.

4. Foot exercise device according to claim 1, wherein an additional outer sole is provided on the underside of the sole.

5. Foot exercise device according to claim 1 wherein additional reinforcement elements are provided, which either run within the sole or engage around it.

6. Foot exercise device having at least one attachment means for a foot and having a sole that forms a closed accommodation space having one or more compressible chambers, to accommodate a particulate material or a fluid, wherein the surface of the sole reaches beyond the foot surface circumferentially around the sides and wherein a shaft configured to be partly open or closed is provided as an attachment means for the foot.

7. Foot exercise device according to claim 1, wherein at least one shaft strap or one braided shaft strap is provided as an attachment means for the foot.

8. Foot exercise device according to claim 1, wherein one or more cuffs is or are provided as attachment means for the foot, which cuffs engage around the back of the foot and/or the heel and/or the ankle.

* * * * *